US007757935B2

(12) United States Patent
Clougherty

(10) Patent No.: US 7,757,935 B2
(45) Date of Patent: Jul. 20, 2010

(54) COMPOSITE CONTAINER WITH INTEGRATED EASY-OPEN FEATURE

(75) Inventor: Kenan J. Clougherty, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 982 days.

(21) Appl. No.: 11/425,763

(22) Filed: Jun. 22, 2006

(65) Prior Publication Data

US 2007/0295795 A1 Dec. 27, 2007

(51) Int. Cl.
*B65D 3/26* (2006.01)

(52) U.S. Cl. ..... 229/202; 229/4.5; 206/830

(58) Field of Classification Search ..... 229/201, 229/202, 87.18; 206/830
See application file for complete search history.

(56) References Cited

U.S. PATENT DOCUMENTS

| | | | | |
|---|---|---|---|---|
| 2,793,126 | A | 5/1957 | Fienup et al. | |
| 2,891,714 | A | 6/1959 | Vallas | |
| 3,035,753 | A | 5/1962 | Erekson | |
| 3,051,370 | A | 8/1962 | Hanlon | |
| 3,093,293 | A | 6/1963 | Freese | |
| 3,102,818 | A | 9/1963 | Zoeller et al. | |
| 3,147,902 | A | 9/1964 | Miller | |
| 3,214,078 | A | 10/1965 | Leezer | |
| 3,221,975 | A | 12/1965 | Zoeller et al. | |
| 3,241,739 | A | 3/1966 | Ahlemeyer | |
| 3,304,185 | A | 2/1967 | Fortney | |
| 3,331,549 | A | 7/1967 | Beasley | |
| 3,366,493 | A | 1/1968 | Stump | |
| 3,712,534 | A * | 1/1973 | Fienup et al. | 229/202 |
| 3,940,496 | A | 2/1976 | Turpin et al. | |
| 3,972,468 | A | 8/1976 | Reid | |
| 4,073,950 | A | 2/1978 | Hansen et al. | |
| 4,241,834 | A * | 12/1980 | Beauchamp | 229/202 |
| 5,076,440 | A | 12/1991 | Drummond | |
| 5,205,479 | A | 4/1993 | Rice et al. | |
| 5,487,506 | A | 1/1996 | Drummond et al. | |
| 5,494,215 | A | 2/1996 | Drummond et al. | |
| 5,547,451 | A | 8/1996 | Drummond et al. | |
| 5,713,824 | A | 2/1998 | Drummond et al. | |
| 2001/0019076 | A1 * | 9/2001 | Varadarajan | 229/4.5 |
| 2004/0118904 | A1 * | 6/2004 | Versluys | 229/4.5 |

* cited by examiner

*Primary Examiner*—Nathan J Newhouse
*Assistant Examiner*—Christopher Demeree
(74) *Attorney, Agent, or Firm*—Alston & Bird LLP

(57) ABSTRACT

A composite container for refrigerated dough products comprises a body ply helically wrapped about an axis to form a tubular body, opposite edges of the helically wrapped body ply being juxtaposed to form a butt joint therebetween. A label is helically wrapped about and adhered to the tubular body, the label comprising an inner layer adhered to the outer surface of the tubular body and an outer layer adhered to a radially outer surface of the inner layer. The inner layer defines a helically extending line of weakness positioned in alignment with the butt joint of the body ply. The outer layer comprises a removable peel strip that is peelable from the inner layer, the peel strip extending helically along the tubular body straddling the line of weakness and butt joint.

20 Claims, 1 Drawing Sheet

COMPOSITE CONTAINER WITH INTEGRATED EASY-OPEN FEATURE

BACKGROUND OF THE INVENTION

The present invention relates to composite containers for refrigerated dough products, wherein the container is opened by separating a body ply of the container along a helically extending butt joint between the edges of the body ply, so as to form an opening through the container body for removal of the dough products.

In conventional containers of this type, an outer label ply wound about and adhesively attached to the paperboard body ply holds the butt joint closed against the pressure of the expanded dough in the container until the consumer opens the container. The opening of the container is typically initiated by peeling the label off; in many cases, the pressure of the expanded dough in the container then forces the butt joint open. Ideally the label is supposed to peel off in one piece so that the container will open properly, and so that printing on the label, such as instructions for baking the dough products, can be read.

One of the difficulties often encountered in conventional dough containers is that the label may not peel off in one piece. The strength of the adhesive bond between the label and body ply is dependent on numerous variables, some of which (e.g., the humidity or other storage conditions for the container prior to opening) are not under the control of the container designer. If the label fragments when the consumer begins peeling it off, then the container may be harder to open. Once the label fragments, it is often difficult to grasp the label again to resume peeling it. Additionally, the fragmenting of the label can render any printing on the label difficult to read.

Dough containers have been developed that incorporate a narrow tear strip that covers the helical butt joint and is pulled to initiate opening of the container. The tear strip is often interposed between the body ply and the label. This approach entails additional costs for the tear strip. Such narrow strips are also difficult to handle with automated web-handling equipment, and thus pose significant manufacturing challenges in terms of manipulating and accurately placing the narrow tear strip into the container structure, in alignment with the container butt joint, as part of the spiral winding process.

BRIEF SUMMARY OF THE INVENTION

The present invention addresses the above needs and achieves other advantages. In accordance with one embodiment of the invention, a composite container for refrigerated dough products comprises a body ply helically wrapped about an axis to form a tubular body, opposite edges of the helically wrapped body ply being juxtaposed to form a butt joint therebetween, the tubular body having a radially inner surface and a radially outer surface. The container can include a liner attached to the inner surface of the tubular body to provide a barrier against transmission of liquids and gases. A pair of end closures are respectively affixed to opposite ends of the tubular body. A label is helically wrapped about the tubular body and adhered to the outer surface thereof, the label comprising an inner layer adhered to the outer surface of the tubular body and an outer layer adhered to a radially outer surface of the inner layer. The label has an integrated easy-open feature that is built into the label structure.

More particularly, the inner layer of the label defines a helically extending line of weakness positioned in alignment with the butt joint of the body ply. The outer layer is coextensive with the inner layer and comprises a removable peel strip that is peelable from the inner layer, the peel strip extending helically along the tubular body straddling the line of weakness and butt joint. The peel strip is peelably adhered to the inner layer so as to prevent the line of weakness from severing until the peel strip is peeled from the inner layer, whereupon internal pressure from expansion of the refrigerated dough products is able to assist in severing the line of weakness in the inner layer and forcing the butt joint open to create an opening in the tubular body for removal of the dough products.

In one embodiment, the peel strip is a die-cut or laser-cut portion of the outer layer that is detachable from the remainder of the outer layer. When the peel strip is peeled off the inner layer of the label, the remainder of the outer layer remains adhered to the inner layer. Alternatively, the entire outer layer can constitute the peel strip and can be peeled off in one piece.

When the outer layer is die-cut or laser-cut to define the peel strip, different adhesives can be used for adhering the peel strip and the remainder of the outer layer to the inner layer. For example, a first adhesive that is relatively easily peelable can be used to adhere the peel strip to the inner layer, while a second adhesive that is relatively less peelable can be used to adhere the remainder of the outer layer to the inner layer. The peelable adhesive can comprise a pressure-sensitive adhesive (PSA) or high shear-strength adhesive. The second adhesive can comprise a laminating adhesive. The outer layer can also be cut to define a tab for the peel strip that can easily be grasped and pulled to peel the peel strip off the container. The tab is preferably free of adhesive so that it can be easily grasped.

Alternatively, when the entire outer layer comprises the peel strip, the entire outer layer is adhered to the inner layer with a peelable adhesive such as PSA.

The inner layer of the label can comprise a polymer film, with or without a paper backing. The paper backing can facilitate adhering the label to the body ply of the container and can also act as a strength component of the structure. The outer layer can comprise a polymer film. Various polymer materials can be used in the manufacture of the label, including but not limited to polyester, polyethylene, polypropylene, polyamide, and the like. If desired, the polymer film can be metallized (i.e., having a thin vapor-deposited layer of substantially pure metal such as aluminum applied to a surface of the film) for barrier performance and/or for imparting a metallic appearance to the film.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
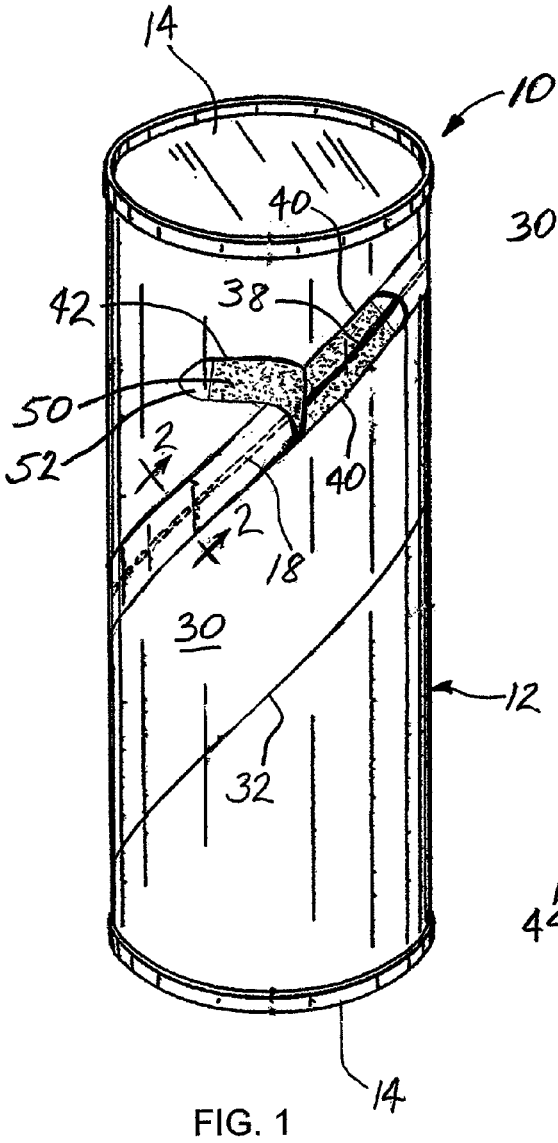
FIG. 1 is a perspective view of a container in accordance with one embodiment of the invention.
Figure 2:
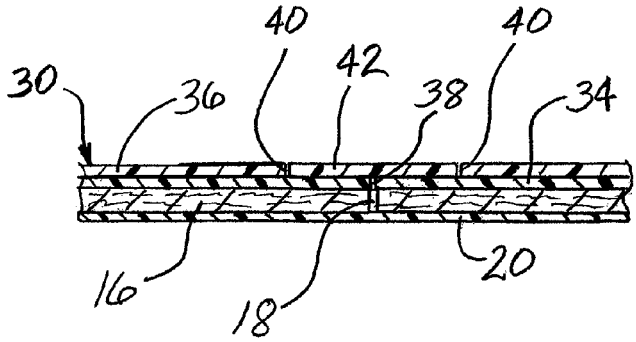
FIG. 2 is a cross-sectional view through line 2-2 in FIG. 1.

With reference to FIGS. 1 and 2, a composite container 10 in accordance with one embodiment of the invention is illustrated. The container includes a tubular container body 12 and a pair of end closures 14 affixed to the opposite ends of the container body. The end closures can comprise metal ends that are double-seamed or crimp (false) seamed onto the ends of the container body, or any other suitable type of end closures affixed in any suitable manner to the container body. The tubular container body is formed by helically or spirally winding various flexible materials in the form of strips about a forming mandrel and adhering the successive layers of the materials to one another with suitable adhesives. The container body comprises a body ply 16 that forms the main structural component of the container body. The body ply can comprise paperboard or the like. The body ply 16 is helically wound such that a butt joint 18 is formed between the opposite edges of successive helical turns of the body ply. The container body advantageously includes an impervious liner ply 20 adhered to the radially inner surface of the body ply. The liner ply prevents or substantially impedes the transmission of liquids and/or gases or vapors therethrough.

A label 30 is helically wrapped about the body ply 16 and is adhered to the body ply with a suitable adhesive. The label is positioned with respect to the body ply such that each edge 32 of the label is not aligned with the butt joint 18 but rather is axially offset from the butt joint. The label comprises an inner layer 34 that is directly adhered to the body ply 16, and an outer layer 36 that is adhered to a radially outer surface of the inner layer. The inner layer has a line of weakness 38 along which the inner layer can be severed relatively easily. The line of weakness can comprise a line of spaced-apart perforations or slits extending at least partially through the thickness of the inner layer, or a continuous slit through the inner layer. The line of weakness extends lengthwise along the label 30, parallel to and spaced from each of the opposite edges 32 of the label. The outer layer 36 in the illustrated embodiment has a pair of die-cut or laser-cut lines 40 that extend substantially or completely through the thickness of the outer layer and that are spaced on opposite sides of and parallel to the line of weakness 38 in the inner layer. The portion of the outer layer 36 between the cut lines 40 comprises a peel strip 42 that is severable from the remainder of the outer layer. The peel strip 42 straddles the line of weakness 38 in the inner layer. The peel strip is adhered to the inner layer using an adhesive that permits the peel strip to be peeled from the inner layer relatively easily and in one piece, as further described below.

The label 30 is helically wound about the body ply 16 such that the line of weakness 38 in the inner layer of the label is aligned with the butt joint 18 of the body ply, as best seen in FIG. 2. Accordingly, the peel strip 42 straddles the butt joint 18. As long as the peel strip is still adhered to the inner layer 34 of the label, the peel strip prevents the inner layer from severing along the line of weakness 38, and thus prevents the butt joint 18 from coming apart. However, when the peel strip is peeled off, the internal pressure of expanded dough within the container body forces the butt joint apart and the line of weakness 38 fractures so that the body ply can be separated at the butt joint to create an opening through which the dough products are removed. Alternatively, removal of the peel strip exposes the line of weakness 38 in the inner layer 34 to allow the container to be opened by application of force to the line of weakness, such as by pressing a finger or implement against the inner layer at the line of weakness.

Figure 3:
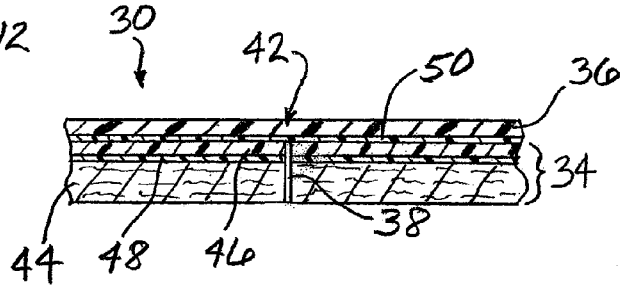
FIG. 3 is a cross-sectional view through a label in accordance with one embodiment of the invention.

With reference to FIG. 3, a particular label structure in accordance with one embodiment of the invention is illustrated. The label 30 has an inner layer 34 that includes a paper backing layer 44 that facilitates adhering the label to the paperboard body ply of a container body. The paper layer 44 can also supply structural strength to the label. The inner layer further comprises a polymer film layer 46 adhered to the paper backing layer using a suitable adhesive layer 48. The line of weakness 38 extends through the thickness of the paper backing layer 44 and at least partially through the thickness of the polymer film layer 46. The outer layer 36 comprises a polymer film, and a portion of the outer layer forms the peel strip 42 that is severable from the remainder of the outer layer. Suitable examples of polymer films for the outer layer include but are not limited to polyester such as polyethylene terephthalate (PET), metallized PET, oriented polypropylene (OPP), metallized OPP, or the like. If desired for barrier and/or appearance reasons, the outer layer can be metallized by vapor-depositing a thin layer of substantially pure metal such as aluminum onto one surface of the film.

The peel strip 42 is adhered to the inner layer using a peelable adhesive 50. Advantageously, the peel strip 42 has a tab 52 that is die-cut or laser-cut through the thickness of the outer layer 36. The tab 52 can be free of the adhesive 50 to permit the tab to be grasped and pulled to initiate peeling of the peel strip. The remainder of the outer layer 36 outside the peel strip can be adhered to the inner layer using an adhesive that differs from the peelable adhesive 50, if desired. For example, the remainder of the outer layer can be adhered to the inner layer using a non-peelable adhesive.

A suitable peelable adhesive for the peel strip 42 can comprise a pressure-sensitive adhesive (PSA). Pressure-sensitive adhesives are often based on non-crosslinked rubber adhesives in a latex emulsion or solvent-borne form, or can comprise acrylic and methacrylate adhesives, styrene copolymers (SIS/SBS), and silicones. Acrylic adhesives are known for excellent environmental resistance and fast-setting time when compared with other resin systems. Acrylic pressure-sensitive adhesives often use an acrylate system. Natural rubber, synthetic rubber, or elastomer sealants and adhesives can be based on a variety of systems such as silicone, polyurethane, chloroprene, butyl, polybutadiene, isoprene, or neoprene. When the laminate of the invention is to be used for food packaging, the pressure-sensitive adhesive generally must be a food-grade composition. Various pressure-sensitive adhesives are approved by the U.S. Food and Drug Administration for use in food packaging, as regulated by 21 CFR Part 175.A preferred food-grade pressure-sensitive adhesive for use in the present invention is Jonbond 743 available from Bostik Findley. Additives (e.g., particulates or the like) can be added to the pressure-sensitive adhesive to reduce the tenacity of the bond, if desired.

A suitable non-peelable adhesive for the remainder of the outer layer 36 can comprise a laminating adhesive formulated to bond the layers together with a substantially higher bond strength than the first adhesive such that the layers bonded together by the second adhesive are not readily peelable from each other. The laminating adhesive can be, for example, a two-component polyurethane adhesive system, such as Tycel 7900/7283 available from Henkel. However, the invention is not limited to any particular adhesives, and various compositions can be used while still achieving the objectives and advantages of the invention.

To open the container 10, the tab 52 of the peel strip 42 is grasped and pulled outwardly and generally in the helical direction along which the strip is wound, so as to peel the strip off the underlying layer 34 of the label. Once the peel strip is peeled off, the internal pressure of expanded dough within the container body forces the butt joint 18 of the body ply 16 apart and the line of weakness 38 in the inner layer 34 of the label fractures so that the body ply 16 can be separated at the butt joint to create an opening through which the dough products are removed. Advantageously, the majority of the label outer layer 36 remains intact on the can body so that baking instructions or other information printed thereon can still be read. The peel strength between the peel strip and the underlying inner layer of the label can be closely controlled by suitable formulation of the peelable adhesive 50 so that the peel strip can be easily peeled off in one piece. Thus, the invention provides a significant improvement over existing composite can constructions in which an attempt to peel off the entire label from the paperboard can body substantially in one piece often fails when the label fragments and it is then difficult to re-grasp the label to continue peeling.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A composite container for refrigerated dough products, comprising:

a body ply helically wrapped about an axis to form a tubular body, opposite edges of the helically wrapped body ply being juxtaposed to form a butt joint therebetween, the tubular body having a radially inner surface and a radially outer surface;

a liner attached to the inner surface of the tubular body;

a pair of end closures respectively affixed to opposite ends of the tubular body; and a label having opposite longitudinal edges and being helically wrapped about the tubular body and adhered to the outer surface thereof, the label comprising an inner layer adhered by an intervening adhesive layer to the outer surface of the tubular body, and an outer layer adhered to a radially outer surface of the inner layer, the inner layer defining a helically extending line of weakness positioned in alignment with the butt joint of the body ply, the line of weakness being intermediate and spaced from the longitudinal edges of the label and extending at least partially through the thickness of the inner layer, the outer layer being coextensive with the inner layer and comprising a removable peel strip that is peelable from the inner layer, the peel strip extending helically along the tubular body straddling the line of weakness and butt joint, the peel strip being peelably adhered to the inner layer so as to prevent the line of weakness from severing until the peel strip is peeled from the inner layer, whereupon internal pressure from expansion of the refrigerated dough products is able to assist in severing the line of weakness in the inner layer and forcing the butt joint open to create an opening in the tubular body for removal of the dough products.

2. The composite container of claim 1, wherein the outer layer of the label is cut to define the peel strip as narrower than the outer layer, such that the peel strip is detachable from a remainder of the outer layer, whereby the remainder of the outer layer remains adhered to the inner layer when the peel strip is removed.

3. The composite container of claim 2, wherein the outer layer is cut to define a tab for the peel strip.

4. The composite container of claim 2, wherein a first adhesive is disposed between the peel strip and the inner layer for peelably adhering the peel strip to the inner layer, and a second adhesive different from the first adhesive is used to adhere the remainder of the outer layer to the inner layer.

5. The composite container of claim 4, wherein the first adhesive comprises a pressure-sensitive adhesive or high shear-strength adhesive.

6. The composite container of claim 5, wherein the second adhesive comprises a laminating adhesive.

7. The composite container of claim 4, wherein the outer layer is cut to define a tab for the peel strip, and wherein the tab is free of adhesive such that the tab is unadhered to the inner layer.

8. The composite container of claim 1, wherein the inner layer comprises a polymer film.

9. The composite container of claim 1, wherein the inner layer comprises a laminate of a polymer film and a paper backing, the paper backing being adhered to the outer surface of the tubular body.

10. The composite container of claim 1, wherein the outer layer comprises a polymer film.

11. A label for a composite container for refrigerated dough products, the container being formed of a body ply helically wrapped about an axis to form a tubular body having an inner surface and an outer surface, opposite edges of the body ply being juxtaposed to form a butt joint therebetween, the label having opposite longitudinal edges, the label comprising:

an inner layer structured and arranged to be adhered to the outer surface of the tubular body, and an outer layer adhered to one surface of the inner layer, the inner layer defining a longitudinally extending line of weakness such that when the label is helically wrapped about the tubular body of the container the line of weakness is positioned in alignment with the butt joint of the body ply, the line of weakness being intermediate and spaced from the longitudinal edges of the label and extending at least partially through the thickness of the inner layer, the outer layer being coextensive with the inner layer and comprising a removable peel strip that is peelable from the inner layer, the peel strip straddling the line of weakness in the inner layer, the peel strip being peelably adhered to the inner layer so as to prevent the line of weakness from severing until the peel strip is peeled from the inner layer, whereupon internal pressure from expansion of the refrigerated dough products is able to assist in severing the line of weakness in the inner layer and forcing the butt joint open to create an opening in the tubular body for removal of the dough products.

12. The label of claim 11, wherein the outer layer of the label is cut to define the peel strip as narrower than the outer layer, such that the peel strip is detachable from a remainder of the outer layer, whereby the remainder of the outer layer remains adhered to the inner layer when the peel strip is removed.

13. The label of claim 12, wherein the outer layer is cut to define a tab for the peel strip.

14. The label of claim 12, wherein a first adhesive is disposed between the peel strip and the inner layer for peelably adhering the peel strip to the inner layer, and a second adhesive different from the first adhesive is used to adhere the remainder of the outer layer to the inner layer.

15. The label of claim 14, wherein the first adhesive comprises a pressure-sensitive adhesive.

16. The label of claim 15, wherein the second adhesive comprises a laminating adhesive.

17. The label of claim 14, wherein the outer layer is cut to define a tab for the peel strip, and wherein the tab is free of adhesive such that the tab is unadhered to the inner layer.

18. The label of claim 11, wherein the inner layer comprises a polymer film.

19. The label of claim 11, wherein the inner layer comprises a laminate of a polymer film and a paper backing, the paper backing serving to facilitate adhering the label to the outer surface of the tubular body.

20. The label of claim 11, wherein the outer layer comprises a polymer film.

* * * * *